United States Patent [19]

Sheppard et al.

[11] Patent Number: 4,941,951

[45] Date of Patent: Jul. 17, 1990

[54] METHOD FOR IMPROVING A DRILLING PROCESS BY CHARACTERIZING THE HYDRAULICS OF THE DRILLING SYSTEM

[75] Inventors: Michael Sheppard, Missouri City; Zhian Hedayati, Houston, both of Tex.

[73] Assignee: Anadrill, Inc., Sugar Land, Tex.

[21] Appl. No.: 316,251

[22] Filed: Feb. 27, 1989

[51] Int. Cl.[5] ..... E21B 47/06

[52] U.S. Cl. ..... 175/48; 73/151; 340/606

[58] Field of Search ..... 175/25, 26, 38, 48; 73/151, 153, 155; 340/606, 611

[56] References Cited

U.S. PATENT DOCUMENTS

| | | | |
|---|---|---|---|
| 3,324,717 | 6/1967 | Brooks et al. . | |
| 3,517,553 | 6/1970 | Williams et al. . | |
| 3,605,919 | 9/1971 | Bromell et al. . | |
| 3,800,277 | 3/1974 | Patton et al. | 175/48 X |
| 3,968,473 | 7/1976 | Patton et al. | 340/18 LD |
| 4,188,624 | 2/1980 | Hochsprung et al. | 340/606 |
| 4,606,415 | 8/1986 | Gray, Jr. et al. | 175/48 X |
| 4,647,853 | 3/1987 | Cobern | 324/166 |
| 4,660,656 | 4/1987 | Warren et al. | 175/26 |
| 4,733,233 | 3/1988 | Grosso et al. | 340/861 |
| 4,739,655 | 4/1988 | Greer et al. | 73/155 |
| 4,805,449 | 2/1989 | Das | 73/151 |

*Primary Examiner*—William P. Neuder

*Attorney, Agent, or Firm*—John J. Ryberg; Stephen L. Borst

[57] ABSTRACT

A variety of flow and pressure measurements are obtained to characterize the drilling fluids hydraulics system of the borehole drilling process. Notably, a differential pressure measurement which measures the difference between the pressure internal to and external of the drill bit is made close to the drill bit. From this and other measurements are obtained valuable information on whether a change in pressure drop is due to a leak or a lost bit nozzle, on corrections to the downhole weight on bit measurement, on the rate of rotation of a downhole positive displacement drilling motor, on the efficiency of the drilling motor, and on an indication of whether a leak in or a blockage of the drill string has occurred and its location.

13 Claims, 2 Drawing Sheets

METHOD FOR IMPROVING A DRILLING PROCESS BY CHARACTERIZING THE HYDRAULICS OF THE DRILLING SYSTEM

BACKGROUND OF THE INVENTION

During the drilling operation, drilling mud is pumped at high pressure through the interior of a drill pipe to and out through the nozzles of the bit and back to the surface exterior the pipe via the annulus between the drill string and the borehole wall. The purpose of this hydraulic system is multifold, including, cleaning the workface at the bit and carrying the drill cuttings back to the surface, lubricating and cooling the drill bit, stabilizing the borehole that is formed to prevent its collapse and providing a source of power to downhole equipment.

From time to time, a leak might develop between the interior and the exterior of the drill pipe to create a "short circuit" which reduces the effectiveness of the drilling fluid in performing its above listed functions. If such a leak goes undetected and is allowed to persist over time, the flow of the drilling fluid, which is typically loaded with solids, will erode or wash away enough of the material of the drill pipe at the location of the leak as to weaken the pipe to the point of separation (twist off). Lost pipe in the bottom of the well prevents further drilling of the well until such time as the separated portion is retrieved or "fished" from the well. Fishing operations are time consuming and expensive and not always successful. If unsuccessful, the well must be abandoned and a new well or a sidetrack begun. Regardless of the fate of the fishing operation, separated pipe represents a significant financial loss.

Another detrimental event that may occur is a flow restriction or blockage which also interferes with the effectiveness of the drilling fluid in flushing cuttings from the well bore, cleaning the workface, lubricating and cooling the drill bit, and providing a power source. Furthermore, a total blockage has been known to cause the hydraulic pressure in the drill string to rapidly increase with eventual rupture of the drill string or the standpipe which feeds the drilling fluid to the drill string at the earth's surface.

Thus it can be seen that leaks or blockages in the system can have serious consequences so that there is a serious need for effectively characterizing and monitoring the hydraulic system to detect and provide early warning of a leak (washout) or a blockage to allow the driller to act before the leak grows or the pressure increases, under the influence of the high pressure mud, to the degree at which the integrity of the drilling tubulars is jeopardized. It would also be advantageous if such characterizing and monitoring of the hydraulic system of the drilling operation were able to provide corrections to other downhole measurements affected by the hydraulics and to provide indications of operating efficiency of the equipment dependent on the utilization of the power provided by the circulating drilling fluid. It will be understood that there is significant utility in any means available to monitor the state and efficiency of downhole drilling motors which are driven by the flow of the drilling fluids.

SUMMARY OF THE INVENTION

The present invention is directed to the use of novel downhole measurements of pressure (and flow in certain circumstances) to monitor the entire hydraulic system which comprises the drill string and the bore hole. These measurements, in combination with certain surface measurements allow the detection of washouts or restrictions and provide a means of estimating the location and the severity of these events. The invention also includes monitoring the performance of a downhole motor and correcting measurements of downhole weight on bit for the effects of the pressure differential placed across the drill bit by the hydraulic system.

DESCRIPTION OF THE PREFERRED EMBODIMENT

Figure 1:
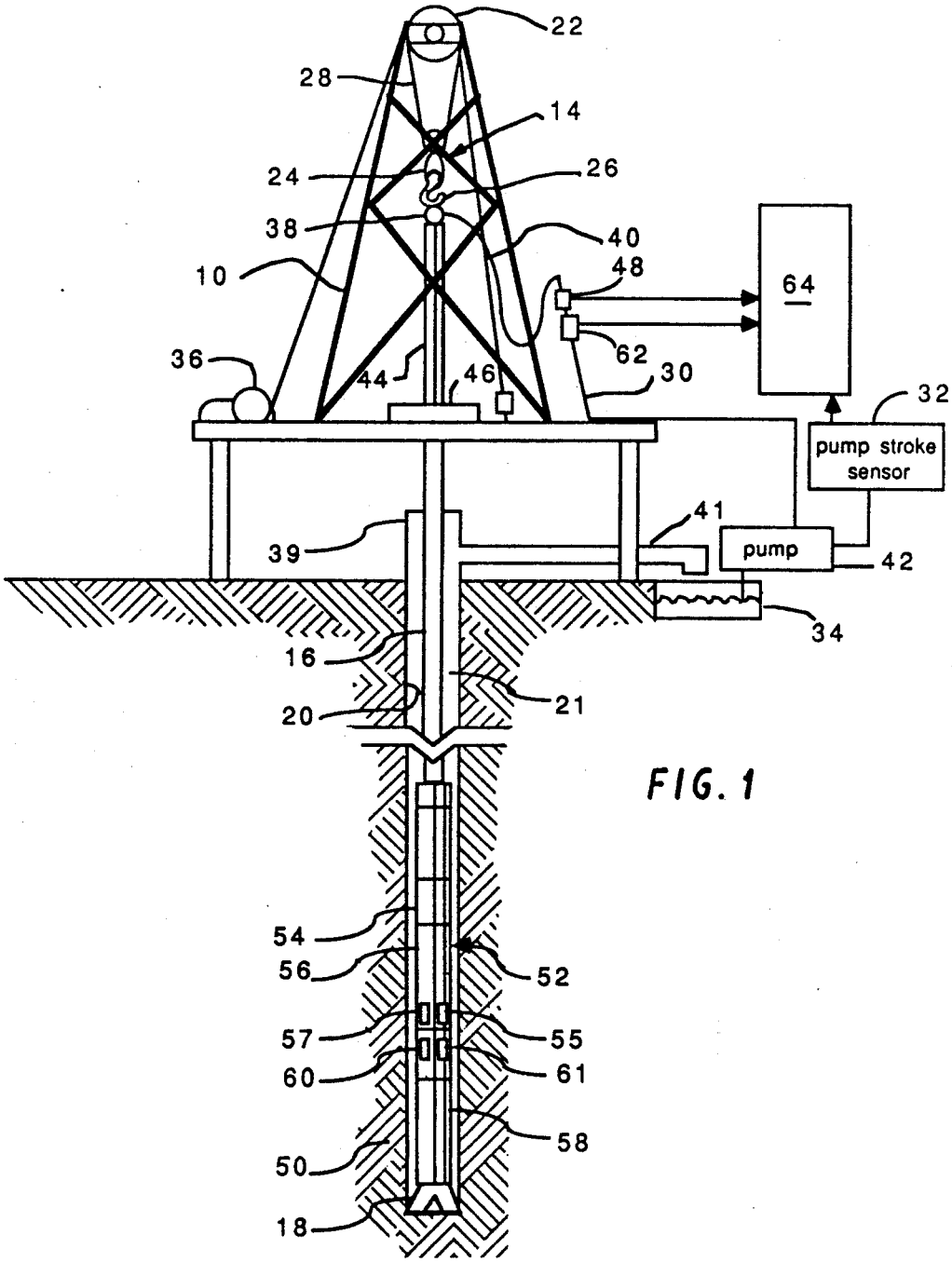
FIG. 1 shows a drilling system including the hydraulics system.

Referring initially to FIG. 1, there is shown a typical rotary derrick comprising a mast 10 standing on the ground and equipped with lifting gear 14, on which is suspended a drill string 16 formed from pipes joined end to end and carrying at its lower end a drill bit 18 for drilling a borehole 20 in subsurface formations 50. An annular region, or annulus 21 exists between the drill string 16 and the borehole walls. Lifting gear 14 comprises a crown block 22, whose spindle is fixed to the top of the mast 10, a vertically mobile travelling block 24, to which is attached a hook 26. Cable 28 passes over blocks 22 and 24 and is wound on to the drum of a winch 36 whereby operation of the winch serves to cause traveling block 24 to rise and descend.

The drill string 16 can be suspended on hook 26 via an injection head 38 connected by a flexible hose 40 and standpipe 30 to a mud pump 42, which makes it possible to inject into the well 20, via hollow pipes of string 16, drilling fluid, usually called "mud", from a mud pit 34. Mud pit 34 receives mud returning from the well 20 via bell nipple 39 and flow return line 41. The rate of flow of the mud into the well is determined by a conventional pump stroke sensor 32 which senses the number of strokes that the pump 42 makes per minute, which information, in combination with knowledge of the volume displaced by each stroke of the pump 42, can be converted into the flow measurement, $Q_1$. During drilling periods, the drill string 16 is rotated by means of the rotating table 46 via a square pipe or "kelly" 44 mounted at its upper end.

At the bottom end of the drill string, there are shown a plurality of downhole components, including a number of heavy drill collars 54 that make up a bottom hole assembly (BHA) 52. A special drill collar or collars 56, referred to herein as the MWD tool for measurement while drilling, is included in the BHA to carry a variety of sensors for the detection of a variety of downhole parameters relating to the drilling process and/or to the properties of the formation 50 being drilled. Typical of the measurements made by the MWD are downhole weight on bit (WOB), downhole torque (TOR), pressure, P, (from sensor 55) either on the interior or the exterior of the drill pipe, gamma ray, electrical resistivity and direction and inclination of the borehole. An additional and non-typical measurement may include a differential pressure measurement, $\Delta P$, which may be provided by a sensor 57 of the type described in U.S. Pat. No. 4,805,449 issued Feb. 21, 1989, the disclosure of which is herein incorporated by reference. Alternatively, the differential pressure measurement may be obtained from two pressure sensors, one sensitive to the pressure internal to the drill pipe and one sensitive to the pressure external to the drill pipe. WOB 60 and TOR 61 transducers may be constructed in accordance with the invention described in U.S. Pat. No. 4,359,898 to Tanguy et al., which is also incorporated herein by reference.

The outputs of the MWD 56 are fed to a transmitter in the MWD portion of the BHA, as is, by now, well known in the industry, for generating modulated acoustic signals that are modulated in accordance with the MWD measurements. The signal is detected at the surface by a receiving pressure transducer 62 and processed by a processing means 64 to provide recordable data representative of the downhole measurements. Although an acoustic data transmission system is mentioned herein, other types of telemetry systems may be employed, provided they are capable of transmitting an intelligible signal from downhole to the surface during the drilling operation.

Also included in the MWD 56 is a module for generating power from the flowing drilling mud for the purpose of powering the downhole sensors and the downhole telemetry apparatus. U.S. reissue patent 30,055 discloses a typical arrangement in which the flowing drilling fluid turns a turbine which is directly connected to a generator/alternator set for generating electrical power. In such an arrangement, the alternator voltage may be monitored as an indication of the flow rate of the fluid flowing through the MWD tool 56. An alternative arrangement is to connect the turbine directly to a pump which pressurizes a downhole tool hydraulics system. With such a downhole hydraulics system, it is possible to generate electrical power by means of a fluidly driven generator but also to supply hydraulic power to other components such as the acoustic telemetry pulser. While the downhole hydraulics system has many advantages, one disadvantage is that a downhole drilling fluid flow signal, $Q_2$, is no longer available from the alternator voltage so that other means for obtaining the downhole flow must be implemented, such as an rpm sensor which monitors the rpm of the turbine driven by the drilling fluid.

Figure 2:
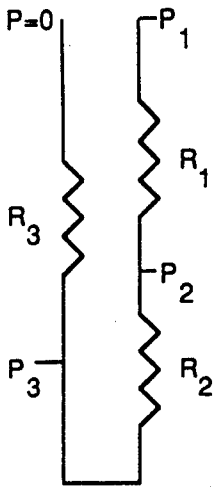
FIG. 2 is a schematic of a drilling hydraulics system without a washout.

Turning now to FIG. 2, a general description of a model of the drilling hydraulics system will be made by way of a schematic of the drilling hydraulic system. By manipulation of pressure and flow measurements made at the surface and downhole, the hydraulic system can be fully characterized. The following discussion will make use of the effective pressures $P_i$ which are defined to be the difference between the measured pressure and the hydrostatic pressure at each location. The hydrostatic component is readily calculated knowing the mud density and the true vertical depth of the MWD tool which may be obtained from survey data and depth measurements. Where differential pressures or pressure drops are discussed, the hydrostatic pressure is not a factor requiring consideration. At the surface, a measurement is made at the stand pipe pressure sensor 48 of the standpipe pressure $P_1$. Also at the surface at the pump stroke sensor 32, a measurement indicative of the flow rate $Q_1$ is determined. Lacking the pump stroke sensor, a flow rate may be obtained by a conventional flow meter. Relatively near the bit at the bottom of the drill string, below the resistive symbol labeled $R_1$ which represents the resistance to flow posed by the interior of the drill string, a measurement is made by the tool 56 of the internal pressure $P_2$ and the external pressure $P_3$. As previously discussed, these measurements may be obtained from a pair of pressure sensors or from a single pressure sensor 55 in combination with a differential pressure sensor 57 of the type disclosed in U.S. patent application Ser. No. 07/126,645 filed Dec. 1, 1987. Clearly, $P_2$ is smaller than $P_1$ by an amount determined by the flow resistance $R_1$. Also, the pressure differential ($\Delta P = P_2 - P_3$) bridges a flow resistance constituting the portion of the BHA below the pressure differential measurement which comprises flow resistance contributions from the PDM (if there is one), the bit (primarily from the bit nozzles) and from the annulus below the pressure differential measurement. The downhole flow rate $Q_2$ at this location is derived from the system pressure $P_1$, or alternatively from a direct measurement of flow rate as previously mentioned. Finally, the flow resistance between the location of the downhole pressure measurements (55,57) and the surface, where the pressure is zero, is represented by $R_3$. Typically $R_3$ will be small, possibly negligible, compared to $R_1$ inasmuch as the flow in the interior of the pipe tends to be turbulent with large flow resistance while the flow in the annulus 21 tends to be laminar with a small flow resistance.

Figure 3:
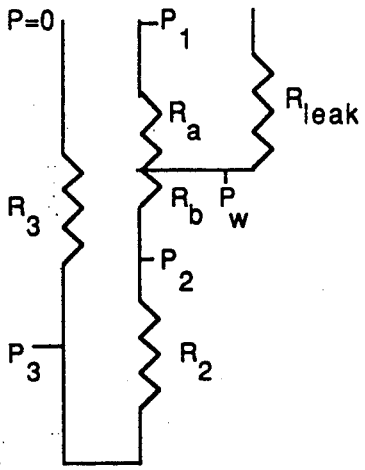
FIG. 3 is a schematic of a drilling hydraulics system with a washout.
Figure 4:
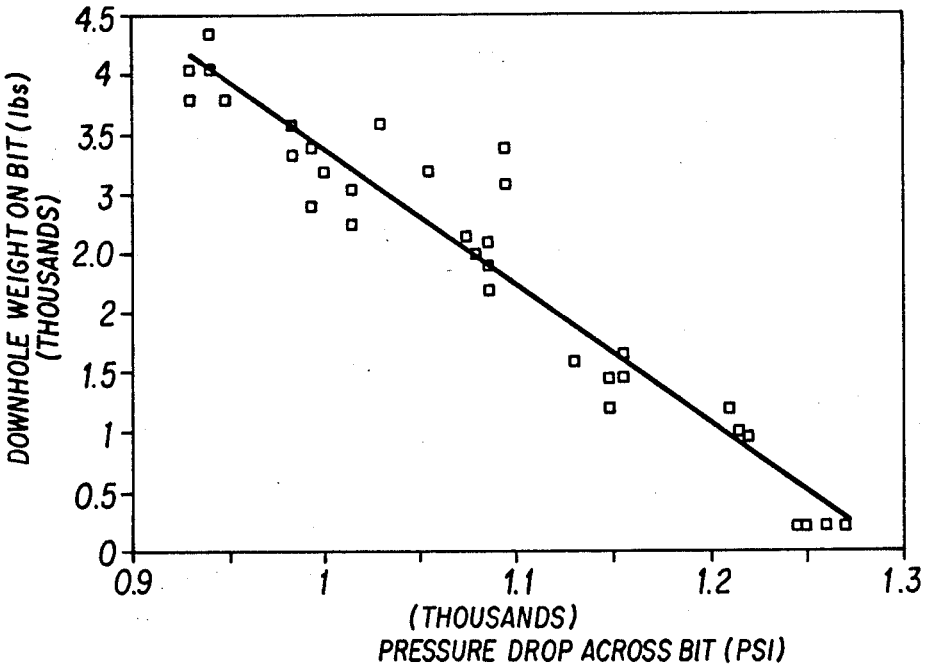
FIG. 4 is a plot of downhole pressure differential across the bit versus the downhole weight on bit.

A similar schematic representation may be constructed to illustrate the situation of a leak in the drill pipe, as has been done in FIG. 3. In that figure, the leak has been illustrated as appearing in the drill pipe above the BHA so that $R_1$ has been split into two portions $R_a$ and $R_b$. The pressure at the point of the leak is designated $P_w$ while the flow resistance from the location of the leak to the surface through the annulus 21 (once again likely to be rather small) is designated as $R_{leak}$.

Lacking a downhole sensor of the drilling fluid flow rate, it is possible in an alternative technique to derive an indication of the downhole flow from the differential pressure measurement, $\Delta P$, available from sensor 57. Without a downhole drilling motor in the drill string, the measurement of $\Delta P$ is dominated by the pressure drop across the bit nozzles. If the area of the nozzles, A, is known then $\Delta P$ is related to the downhole flow rate $Q_2$ by $$\Delta P = \rho Q_2^2/(CA)^2 \quad (1)$$

where $\rho$ is the mud density and C is a nozzle flow factor normally taken to be 0.99. If A is known then equation (1) provides the flow rate through the bit directly. Where the bit nozzle area, A, is in question such as when a bit nozzle might have been lost, then equation (1) is unable to provide the proper bit flow rate. Thus it is important to have a means for determining when a change in the hydraulics of the system arises from the development of a leak above the bit, in which case equation (1) remains valid, or from a lost nozzle, in which case equation (1) would give improper answers.

In this respect, it has been discovered that monitoring the ratio of $\Delta P$ to $Q_1^2$ ($Q_1$ is the surface determined flow rate) is useful since the ratio is dependent both on the flow resistance through the bit as well as the flow resistance through a leak. The dynamics of the dependence is different, however, and serves to provide a logic for determining whether variations in the ratio are due to a leak in the drill string or to a lost bit nozzle. Drill string leaks tend to develop slowly over time while the loss of a bit nozzle occurs rather abruptly. Thus, if the ratio of $\Delta P$ to $Q_1^2$ is monitored relative to time, one can distinguish between lost bit nozzle events and the development of a leak in the drill string. Upon reaching the conclusion that the change in the ratio is gradual rather than abrupt, one may then utilize equation 1 above to determine $Q_2$ and then take the difference between $Q_1$ and $Q_2$ to obtain the flow rate through the leak. Such information is clearly valuable to the driller who is then provided with the type of quantitative information necessary for him to make intelligent decisions about how to proceed with the drilling process.

With reference to the schematic of FIG. 2, the full hydraulic system can be modelled in terms of a series of flow resistances where the pressure drop $FP_i$ across each resistance $R_i$ is given by:

$$FP_i = R_i * Q_i m_i \quad (2)$$

where $Q_i$ is the local flow rate and $m_i$ an exponent having a value between 1 (for laminar flows) and 2 (for turbulent flows).

The value of exponent, m, for the complete system is between 1 and 2 and may be determined by plotting $P_1/Q_1^m$ for a number of values of m at different flow rates. Since R remains constant, the proper exponent m is that exponent that produces least variation in R (or $P_1/Q_1^m$) with variations in flow.

In the above example the normalization exponent for the entire system was obtained. Using the same approach and the differential pressure measurement it is possible to determine the flow regime and the corresponding exponent below the tool 56. Once the exponent m is determined for the whole system as well as below the differential pressure sensor 57, flow restrictions or washouts in the drill string may be detected as described below.

In FIG. 2, $R_1$ represents the drill string and is linearly proportional to pipe length, where the constant of proportionality can be viewed as a (constant) fluid friction per unit length of pipe. $R_2$ represents the bit nozzles (and PDM if present) and $R_3$ represents the annulus which will also vary linearly with pipe depth. Notice that if the mud density is varied the resistances have to be corrected by multiplying each resistance by $\rho_{new}$ mud/$\rho_{old}$ mud where $\rho$ denotes the mud density.

From FIG. 2 it is clear that application of equation 2 determines each resistance and that so long as there are no blockages or leaks, the downhole and surface flow rates are equal. Any blockage or restriction, either in the drill pipe, bit or annulus, is identified by an increase in the resistance associated with that element. Any reduction in the resistance $R_2$ is identifiable as a lost nozzle, or a seal (in PDM) or pipe washout below the differential pressure measurement 57. While drilling, the pressures and flow rates are monitored periodically and the values of each resistance calculated. While the values of $R_1$ and $R_3$ should increase with the pipe depth L the values of $R_1/L$ and $R_3/L$ (i.e. the fluid friction coefficients) should remain constant during trouble free drilling. Any increases in these terms can be interpreted as a blockage. Pipe blockage (a blocked screen for example), bit blockage and an annular blockage can all be distinguished one from another since $R_1$, $R_2$ and $R_3$ are independently determined.

Pipe washouts above the location of the differential pressure sensor 57 are signaled by a lower downhole flow rate $Q_2$ than surface flow rate $Q_1$. These may be quantified in the following way. A pipe washout may be represented by a leakage resistance $R_{leak}$ as shown in FIG. 3. This splits the resistance $R_1$ into two parts $R_a$ and $R_b$ which represent the pipe resistance above and below the washout respectively. The internal pressure $P_w$ at the site of the washout is unknown as is the leakage resistance $R_{leak}$ giving four unknowns in total. We have, however, four equations, namely:

$$P_1 - P_w = R_a * Q_1^m \quad (3)$$

$$P_w - P_2 = R_b * Q_1^m \quad (4)$$

$$R_1 = R_a + R_b \quad (5)$$

$$R_{leak} = P_w/(Q_1 - Q_2)^n \quad (6)$$

where n is the exponent for the leakage current and can be set to 2 in general. Notice in equation 6 it has been assumed that $R_3 << R_a, R_b, R_{leak}, R_2$. Solving equations 3–6 give, in particular, $R_a$, $R_b$, $R_{leak}$ which determine the location of the washout (i.e. at a depth which is equal to $R_a/R_{leak}$* [total pipe length below the rotary table] and the severity of the washout (given by the magnitude of $R_{leak}$). In this way the combination of surface and downhole flows and pressures gives a complete description of the system hydraulics. Incipient washouts can be identified before there is a significant danger of parting the string and an estimate of the location of the washout can be made which saves time spent finding the damaged pipe joint in order to replace it.

One of the calculations made by the driller is the pressure drop across the bit while circulating. This is needed in the evaluation of cleaning at the bit and for estimates of pressure losses elsewhere in the system. The conventional way to do this is by using equation 1 (Bernoulli's equation), where the flow $Q_1$ is determined from the pump stroke sensor 32. Tests have revealed, however, that when a plot of actual, measured pressure drop across the bit versus flow rate is made and compared to the expected range of pressure drops calculated by the driller, which assumes 100% pump efficiency and which follows the traditional method, the calculated pressure drops are overrestimated. This over estimation may arise from a postulated pressure recovery mechanism or from the fact that an estimated pump efficiency of 100% is over optimistic. Thus it is concluded that the better procedure for obtaining bit pressure drop is to use the downhole measurement of differential pressure with the result that questions regarding hydraulic pump efficiency and accuracy of pressure drop models are avoided.

As is known, the BHA may comprise a large number of different components arranged in a variety of different manners in order to produce a variety of different behaviors. For example, one objective to be achieved by the proper design of the BHA is the directional control of the course of the borehole. In furtherance of this objective, the BHA may include a downhole drilling motor 58 with or without a bent housing, a bent sub, full gauge or undergauge stabilizers and reamers etc. Of particular interest is a positive displacement motor, PDM, of the single or multi lobed type. As will be described below, monitoring of the flows and pressures of the drilling fluid may be taken advantage of by the present invention to advise the driller on the state and condition of the PDM. For example, leaks around the rotor portion of the PDM through failing seals or bearings may be detected as well as the relative efficiency of motor.

When a positive displacement motor (PDM) 58 is used as part of the BHA, the system hydraulics is affected. A PDM derives its power from the hydraulic force of the drilling fluid as it makes its way between the PDM's stator and rotor. As a result there is a pressure drop across the PDM proportional to the torque which the motor delivers. The PDM is normally positioned below the MWD, therefore the pressure drop across the motor is reflected in the differential pressure measurement of sensor 57. Since the PDM pressure drop constitutes a significant portion of the total pressure losses in the system, it is important to understand and model the PDM hydraulics.

In an ideal motor, with no leaks or friction, the rotational speed is proportional to the flow rate. In reality, however, there is always some leakage between the steel rotor and the elastomer seal covering the stator. During rotation the elastic seal suffers temporary deformation created by the successive impact of the rotor, and results in additional play and leakage. The amount of leakage depends on the pressure across the seals, as well as the wear state of the seals, and increases with increasing pressure. As the leakage flow increases, the volume of fluid available to turn the rotor is reduced, and consequently the rotation speed drops. For example, in a fixed lithology and at fixed total flow rate, $Q_1$, if the weight on bit is increased the torque requirement at the bit will increase as well. To meet this higher torque requirement the pressure drop across the motor must increase, which in turn leads to a higher seal leakage and consequently a lower rotation speed.

The effect of wear of the elastomer seals may be illustrated by considering the following. While drilling in a fixed formation with a clean bit and at fixed weight, a particular torque is required to turn the bit; at a fixed flow rate this requires a certain pressure drop $p_i$ across the PDM. As the seals deform, there are increased pressure losses associated with the leakage and less hydraulic power is available to turn the rotor. To achieve the original torque a greater pressure drop $p_1$ is required across the motor to make up for the pressure loss associated with the leaks. If the torque output of the motor is lower than that required to turn the bit, the rotation speed inevitably drops. Reducing the rotation speed leads to an increase in the pressure drop across the motor; the speed will drop until $p_1$ is attained. Note that although the pressure has increased the total useful power output of the motor (equal to the product of torque and rotor rpm) has dropped, since the rpm is lower for the same torque output. The extra power has been used to drive the fluid through the seals. If the torque requirements at the bit become higher than the motor can deliver, a stall will occur: the motor rpm drops to zero and all the working fluid passes through the leaks.

The pressure drop across the motor 58 may be calculated from either the downhole or surface measurements of pressure and flow rate. The downhole measurement of differential pressure, as mentioned earlier, represents pressure losses below the differential pressure sensor 57 and includes losses across the bit nozzles and those across the PDM 58. Pressure losses across the motor, therefore, may be obtained by simply subtracting the bit pressure losses from the $\Delta P$ measurement:

$$Pmotor = \Delta P - Pbit \quad (7)$$

The bit pressure drop may be either calculated theoretically or measured more accurately from a determination of $\Delta P$ which is measured when the bit is raised off of the bottom of the borehole. The surface measurements may be used to calculate the motor pressure drop according to the following relations:

$$Pmotor = (P_n - P_{n\text{-}off})^* Q^m \quad (8)$$

where P represents the pressure loss in the whole system, Q is the total flow rate into the system and $P_n$ is defined as being the ratio of $P/Q^m$. $P_{n\text{-}off}$ refers to the last recorded off-bottom value of $P/Q^m$. While off-bottom, the motor is delivering minimal torque therefore the motor pressure drop is very small. The off-bottom value of $P_n$ represents the hydraulic resistance of the whole system excluding the PDM resistance, whereas the on-bottom value of $P_n$ includes the PDM hydraulic resistance. The $P_n - P_{n\text{-}off}$ difference therefore represents the PDM hydraulic resistance alone and may be solved to give the pressure drop across the motor in physical units.

Because the optimum operating conditions for a PDM will vary as the motor seals wear, efficiency (or wear) calculations are of particular importance. Furthermore, sudden changes in efficiency may be interpreted as the occurrence of one of various events such as seal washouts, PDM bearing damage, etc. Continued operation of a PDM leads to wear in the elastomer seals and increasing leakage through those seals. With increased leakage, a larger pressure drop across the motor is required to deliver the same torque. Where a downhole torque measurement is made directly above the motor, 58, the torque measurement accurately represents the torque delivered by the motor. Therefore the ratio of delivered torque to pressure drop across the motor provides a measure of the wear state of the seals and consequently the PDM efficiency.

The ratio of downhole torque to PDM pressure drop may also be used to aid the detection of a variety of drilling events. For example a washout below the differential pressure measurement can be detected from changes in the system hydraulics, as described above. Such a washout may have originated in the rotor/stator seal, the PDM thrust bearing, or the bit nozzles. The torque/pressure ratio can be used to distinguish between the three. A leakage in the rotor/stator seal leading to a washout is detected as a gradual decrease in the torque/pressure ratio until both the torque measurement and the motor pressure drop vanish, because once the seal washes out the rotor will no longer be turning. A washout in the thrust bearings appears similar to a bit nozzle washout in that the pressure drop across the motor will decrease without affecting the delivered torque so that the torque/pressure ratio will as a result increase. Torque losses increase as the thrust bearings wear.

With each turn of the rotor of the PDM inside the stator, the flow of drilling fluid is partially blocked and pressure pulses are generated in the mud column. These pressure pusles are thus imposed on the differential pressure signal detected by sensor 57. Spectrum analysis of the $\Delta P$ measurement therefore determines this frequency and thus the motor speed. The frequency of these pulses is related to the motor rpm as:

$$\text{Frequency} = N^* (N+1)^* \text{ rpm}/60 \quad (9)$$

where N is the number of rotor lobes. The motor speed is a valuable diagnostic; in addition to clarifying the interpretation of the above events, the maximum power output of the motor may be directly identified as the point at which the product of the motor speed and the downhole torque is a maximum. Maintaining drilling procedures which yield maximum power will result in most efficient drilling.

The differential pressure, ΔP, also gives rise to a tensile stress acting at the strain gauges in the sensors that measure the downhole weight on bit. The effect of increasing ΔP is to reduce the downhole measured value of weight on bit. The magnitude of this stress is linear in ΔP with a proportionality coefficient equal to the effective internal flow area, A, in the region of the gauges. (This effective area takes account of the bit nozzles and flow through a PDM if present, internal pressure compensation etc.).

The coefficient of proportionality can be determined either by direct measurement of the tool internal geometry or by measurement of ΔP and WOB at different flow rates while the bit is off of the bottom of the borehole. FIG. 6 shows a plot of the measured WOB against the measured ΔP obtained while circulating off bottom at a range of flow rates with a BHA that included a PDM. The slope of the least squares fit to the points is 11.5 $in^2$. This is in fact close to 11.65 $in^2$ which is the measured internal area in the gauge region. In situations in which the PDM is excluded from the BHA, the nozzle area of the bit should be subtracted from the internal area.

Once the slope (A) of the least squared fit of the data points of FIG. 6 is determined from an off bottom test, the WOB measurement is zeroed off bottom at the prevailing flow rate. Then, when the well is being drilled, if ΔP is changed by an increment, e, a real time correction can be made for the effects of the pressure differential change on the WOB strain gauge sensors according to the following expression $$DOB_{actual} = WOB_{measured} + eA. \quad (10)$$

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for improving the understanding of the process of drilling a borehole through a subsurface geological formation with a drill string at the bottom of which is a drill bit and through which drilling fluids are circulated, comprising the steps of:

a. providing measuring devices near the bottom of the drill string for measuring the pressure drop across the drill bit and the axial load placed on the drill bit;

b. raising the drill string to lift the drill bit off of the bottom of the borehole so that the axial load placed on the bit due to the weight of the drill string is reduced to zero;

c. making a first measurement indicative of the pressure drop across the drill bit at a plurality of different flow rates while at the same time making a second measurement indicative of the signal from the measuring device for measuring axial load on the drill bit;

d. combining said first and second measurements to obtain a constant representative of the rate of change of said first measurement relative to the rate of change of said second measurement;

e. drilling said formation while determining the weight on the drill bit and the pressure drop across the drill bit; and f. combining said weight on the drill bit, said pressure drop across the drill bit and said constant in order to generate a weight on bit signal corrected for the effects of pressure drop across the drill bit.

2. A method for improving the process of drilling a borehole with a drill string through which is circulated drilling fluid, said drill string including a downhole motor and a drill bit, the method comprising the steps of:

a. determining the pressure drop across the downhole motor;

b. determining the downhole torque applied to the drilling bit; and c. forming the ratio of the downhole torque to the motor pressure drop as an indication of the efficiency of the operation of the motor; and d. modifying a drilling variable in response to said indication of motor efficiency.

3. The method as recited in claim 2 wherein said step of determining the pressure drop across the downhole motor comprises the steps of:

a. providing a differential pressure sensor near the drill bit but above the downhole motor;

b. measuring the differential pressure with said differential pressure sensor when the bit is off of the bottom of the borehole;

c. measuring the differential pressure with said differential pressure sensor when the bit is drilling the bottom of the borehole; and d. compraring the differential pressures of steps b and c.

4. The method as recited in claim 2 further comprising the step of distinguishing between a positive displacement motor seal washout and a motor thrust bearing washout or a lost bit nozzle by monitoring the rate of change of the motor efficiency, whereby a seal washout is indicated when the motor efficiency decreases slowly and a thrust bearing washout or a lost bit nozzle is indicated when the motor efficiency increases.

5. In a drilling process in which a borehole is drilled by a drill string at the bottom of which is a drill bit having nozzles and through which drilling fluids are circulated, a method of determining the flow rate $Q_{bit}$ of said drilling fluids through said drill bit, said method comprising the steps of:

a. measuring the differential pressure between the inside of the drill string and the outside of the drill string;

b. deriving the density of the drilling fluid;

c. deriving a value for the area of the bit nozzles;

d. determining said flow rate, $Q_{bit}$, in response to the values of steps a, b, and c according to the relationship:

$$\Delta P = \rho Q_{bit}^2/(CA)^2$$

where

ΔP = pressure differential,

ρ = the density of the flowing fluid,

C = a bit nozzle flow factor normally taken to be 0.99, and

A = the area of the bit nozzle.

6. A method for identifying the occurrance of washouts or restrictions in a drill string in a borehole at the bottom of which is a drill bit and through which drilling fluids are circulated, said drill string having a device for measuring a differential pressure between the inside and the outside of said drill string near said bit, said method comprising the steps of:

a. measuring the differential pressure, $\Delta P$, near the drill bit;

b. measuring the flow rate, Q, of the drilling fluid entering the drill string; and c. monitoring the ratio of $\Delta P$ to $Q^2$ and modifying the drilling process in response thereto, whereby the ratio's gradual decrease is indicative of a washout above the location of said device for measuring differential pressure, $\Delta P$, its abrupt decrease is indicative of a lost bit nozzle, and its increase is indicative of a restriction to the flow of said fluid.

7. The method as recited in claim 6 further including the step of when a lost bit nozzle is not indicated, deriving the flow rate, $Q_{bit}$, through the bit in response to said measurement indicative of the pressure differential according to the relationship:

$$\Delta P = \rho Q_{bit}^2/(CA)^2$$

where $\Delta P$ = pressure differential, $\rho$ = the density of the flowing fluid, C = a bit nozzle flow factor normally taken to be 0.99, and A = the area of the bit nozzles.

8. The method as recited in claim 7 further including the step of determining the magnitude of flow rate through a leak by comparing said flow rate, Q, of the fluid entering the drill string and said flow rate through the bit, $Q_{bit}$.

9. A method for controlling the process of drilling a borehole through subsurface geological formations with a drill string at the bottom of which is a drill bit and through which drilling fluids are circulated, the method comprising the steps of:

a. measuring the rate of flow of the drilling fluid as it is injected into the drill string;

b. determining the pressure of the drilling fluid at at least the earth's surface and at a downhole location near the drill bit;

c. in response to said measure or flow rate and to said pressure measurements, determining the hydraulic resistance of the drill string over at least a portion of its length pursuant to the relationship $$FP_i = R_i Q_i^{mi}$$

where $FP_i$ is the pressure drop across said portion, $R_i$ is the hydraulic resistance of said portion $Q_i$ is the rate of fluid flow through said portion, and mi is between 1 and 2; and d. monitoring said hydraulic resistance as an indication of a blockage of or a leak in said drill string, whereby a blockage is indicated by an increase and a leak is indicated by a decrease in said hydraulic resistance.

10. The method as recited in claim 9 wherein said drill string includes a sensor near said drill bit for measuring differential pressure, said method including the step of measuring the differential pressure and wherein a hydraulic resistance is determined further in response to said differential pressure for three portions of said drill string: a first portion comprising the interior of said drill string from the earth's surface to said differential pressure sensor, a second portion comprising the interior and the exterior of said drill string below said differential pressure sensor, and a third portion comprising the annular space between said drill string and the borehole wall from said differential pressure sensor to the earth's surface.

11. The method as recited in claim 10 further comprising the step of determining the location of a leak, wherein said step of determining the location of a leak includes the steps of:

a. solving the following set of simulteaneous equations for $R_a$ and $R_{leak}$ $$P_1 - P_w = R_a Q_1^m$$

$$P_w - P_2 = R_b Q_1^m$$

$$R1 = Ra + Rb$$

$$R_{leak} = P_w/Q_1 - Q_2)^2$$

where $P_1$ is the surface pressure of the injected fluid $P_2$ is the downhole pressure at the location of said differential pressure sensor, $Q_1$ is the flow rate of the drilling fluid injected into said drill string, $Q_2$ is the downhole flow rate of the drilling fluid at the location of said differential pressure sensor, $P_w$ is the fluid pressure at the location of the leak, $R_1$ is the hydraulic resistance between the earth's surface and the location of the differential pressure sensor, Ra is the hydraulic resistance between the earth's surface and the location on the leak, Rb is the hydraulic resistance between the location of the leak the location of the hydraulic pressure sensor, and $R_{leak}$ is the hydraulic resistance of the leak, and m is between 1 and 2; and b. determining the location of the leak from the relationship $$\text{leak location} = L.R_a/R_{leak}$$

where L is the total length of drilling pipe from the earth's surface to the location of said differential pressure sensor.

12. A method for determining the rate of rotation (rpm) of a hydraulically driven downhole positive displacement drilling motor having N number of rotor lobes, said motor generating pressure pulses of a certain frequency in the drilling fluid in which said motor operates, said method comprising the steps of:

a. making a pressure measurement in said drilling fluid over time;

b. performing a spectrum analysis of said pressure measurement, thereby determining said frequency of said pressure pulses generated by said downhole motor;

c. from said frequency determined in step b, determining said rate of rotation rpm of said motor from the relationship:

$$\text{Frequency} = N^* (N+1)^* \text{ rpm}/60.$$

13. The method as recited in claim 12 wherein said pressure measurement is a differential pressure measurement responsive to the difference in pressure between the inside and the outside of a drill pipe above said drilling motor.

* * * * *